US010224643B2

(12) United States Patent
Moon et al.

(10) Patent No.: US 10,224,643 B2
(45) Date of Patent: Mar. 5, 2019

(54) RADIO COMMUNICATION ANTENNA HAVING NARROW BEAM WIDTH

(71) Applicant: KMW Inc., Hwaseong, Gyeonggi-Do (KR)

(72) Inventors: Young-Chan Moon, Gyeonggi-do (KR); Oh-Seog Choi, Gyeonggi-do (KR); In-Ho Kim, Gyeonggi-Do (KR); Sang-Hyeong Kim, Gyeonggi-do (KR)

(73) Assignee: KMW INC., Hwaseoung, Gyeonggi-do (KR)

( * ) Notice: Subject to any disclaimer, the term of this patent is extended or adjusted under 35 U.S.C. 154(b) by 175 days.

(21) Appl. No.: 14/941,016

(22) Filed: Nov. 13, 2015

(65) Prior Publication Data

US 2016/0141765 A1 May 19, 2016

Related U.S. Application Data

(63) Continuation of application No. PCT/KR2014/004326, filed on May 14, 2014.

(30) Foreign Application Priority Data

May 14, 2013 (KR) ..... 10-2013-0054537

(51) Int. Cl.
*H01Q 21/00* (2006.01)
*H01Q 21/06* (2006.01)
(Continued)

(52) U.S. Cl.
CPC ..... *H01Q 21/062* (2013.01); *H01Q 9/285* (2013.01); *H01Q 19/108* (2013.01); *H01Q 21/24* (2013.01);
(Continued)

(58) Field of Classification Search
CPC ..... H01Q 21/062; H01Q 9/285; H01Q 9/16; H01Q 19/10
(Continued)

(56) References Cited

U.S. PATENT DOCUMENTS 6,573,874 B1 6/2003 Saito et al.
2003/0011529 A1 1/2003 Gottl
(Continued)

FOREIGN PATENT DOCUMENTS

EP 1906491 A1 4/2008
JP 2005203962 A 7/2005
(Continued)

OTHER PUBLICATIONS

EP Search Report dated Dec. 7, 2016 in corresponding European Patent Application No. 14798586.5.
(Continued)

*Primary Examiner* — Hai Tran
(74) *Attorney, Agent, or Firm* — Mintz Levin Cohn Ferris Glovsky and Popeo, P.C.; Kongsik Kim

(57) ABSTRACT

In the present invention, a radio communication antenna having a narrow beam width comprises: a reflecting plate provided in the form of a plate of rectangular shape; and one radiating module disposed on the reflecting plate and generating x-polarized waves. Here: the radiating module comprises four radiating elements of dipole structure; the four radiating elements are respectively disposed at four edge portions of the reflecting plate, and each comprises two radiating arms placed in the direction extending along both sides relative to the edges; and, among the four radiating elements, those radiating elements that face each other diagonally are linked in movement so as to generate one of the x-polarized waves.

5 Claims, 14 Drawing Sheets

(51) Int. Cl.

| | |
|---|---|
| ***H01Q 9/28*** | (2006.01) |
| ***H01Q 19/10*** | (2006.01) |
| ***H01Q 21/24*** | (2006.01) |
| ***H01Q 21/29*** | (2006.01) |
| *H01Q 1/24* | (2006.01) |
| *H01Q 15/14* | (2006.01) |
| *H01Q 21/26* | (2006.01) |

(52) U.S. Cl.
CPC ..... *H01Q 21/293* (2013.01); *H01Q 1/246* (2013.01); *H01Q 15/14* (2013.01); *H01Q 21/26* (2013.01)

(58) Field of Classification Search
USPC ..... 343/812, 810, 795
See application file for complete search history.

(56) References Cited

U.S. PATENT DOCUMENTS

| | | | | |
|---|---|---|---|---|
| 2005/0237258 | A1 | 10/2005 | Abramov et al. | |
| 2009/0143040 | A1 | 6/2009 | Man et al. | |
| 2009/0278759 | A1* | 11/2009 | Moon | H01Q 1/246 343/810 |
| 2010/0097286 | A1* | 4/2010 | Morrow | H01Q 1/007 343/810 |
| 2012/0146872 | A1 | 6/2012 | Chainon et al. | |

FOREIGN PATENT DOCUMENTS

| | | | | |
|---|---|---|---|---|
| JP | 2010503356 | A | 1/2010 | |
| JP | 2012529826 | A | 11/2012 | |
| KR | 10-2001-0042252 | A | 5/2001 | |
| KR | 10-2008-0023605 | A | 3/2008 | |
| KR | 10-0854470 | B1 | 9/2008 | |
| WO | WO-2008032951 | A1 | 3/2008 | |
| WO | WO-2010142756 | A1 | 12/2010 | |
| WO | WO 2011147937 | A1 * | 12/2011 | H01Q 1/246 |

OTHER PUBLICATIONS

JP Search Report dated Oct. 17, 2016 in corresponding Japanese Patent Application No. 2016-512848.

* cited by examiner

RADIO COMMUNICATION ANTENNA HAVING NARROW BEAM WIDTH

CROSS REFERENCE TO RELATED APPLICATIONS

This application is a continuation of International Application No. PCT/KR2014/004326 filed on May 14, 2014, which claims priority to Korean Application No. 10-2013-0054537 filed on May 14, 2013. The applications are incorporated herein by reference.

TECHNICAL FIELD

The present invention relates to a radio communication antenna (hereinafter, referred to as 'an antenna') used for a base station, a repeater or the like in a radio communication system, and more particularly, to a radio communication antenna that has a narrow beam width.

BACKGROUND ART

An antenna used in a base station including a repeater of a radio communication system may have various shapes and structures, and in recent years, radio communication antennas generally have used a dual polarization antenna structure by applying a polarization diversity scheme.

The dual polarization antenna generally has a structure in which radiation elements, for example, in the form of four dipoles are appropriately arranged on at least one reflective plate that stands in the lengthwise direction thereof, in the form of a tetragonal shape or a rhombus shape. For example, those of the four radiation elements which are located in a diagonal direction are paired, and each of the radiation element pairs are used to transmit (or receive) one corresponding linear polarization of the two orthogonal linear polarizations, for example, arranged at +45 degrees and −45 degrees with respect to a vertical (or horizontal line).

An example of such a dual polarization antenna is disclosed in Korean Patent Application No. 2000-7010785 first filed by Kathrein-Verke Kage (entitled 'Dual polarization multi-band antenna').

Meanwhile, the horizontal beam width of a radio communication antenna generated by each radiation element (and a combination of radiation elements) is one of the very important characteristics of the corresponding antenna, and steady studies on the design of a radiating element and an entire antenna have been conducted to satisfy a beam width required for service conditions and environments. Then, studies for making beam width as wide as possible have been made in order to allow the corresponding antenna to have a wider coverage, and studies for making beam width as narrow as possible have been made to allow the corresponding antenna to have a narrower coverage.

It is preferable to apply a radio communication antenna having excellent side lobe characteristics as well as a narrow beam width to a base station (for example, a small-scale or ultra-small base station/repeater) that may be installed when many subscribers are concentrated on a specific area, such as a stadium or a large scale auditorium. That is, when many subscribers are concentrated on a specific area, a radio communication antenna is designed to have a narrow beam width in consideration of a capacity that may be processed by the corresponding base station/repeater. Furthermore, a business person densely installs base stations/repeaters having radio communication antennas with a narrow beam width in a corresponding area to secure processing capacity for many subscribers.

FIG. 1 is a plan view of a general radio communication antenna having a narrow beam width, in which four radiation modules 11, 12, 13, and 14 that generate an X polarization, respectively are installed on one reflective plate 10 in a rectangular arrangement structure. The radio communication antenna having a narrow beam width forms one radiation beam (having a narrow beam width) by combining the radiation beams of the four radiation modules 11, 12, 13, and 14. Then, the interval between the four radiation modules 11, 12, 13, and 14 is precisely set so that the radiation beams of the four radiation modules 11, 12, 13, and 14 are appropriately combined. The narrow beam width is generally set by providing a constant distance between the radiation modules in consideration of processed frequencies, and the distance between the radiation modules should be longer in order to obtain a narrower beam width.

However, because a radio communication antenna having a narrow beam width is generally applied to a small-scale or ultra-small base station/repeater, the size of an antenna may be a big burden when the corresponding antenna is designed using four radiation modules 11, 12, 13, and 14. Accordingly, a need for a radio communication antenna having a narrow beam width while having a small size is urgently required.

SUMMARY

Therefore, the present invention provides a radio communication antenna for generating a narrower beam width while having a smaller size.

The present invention also provides a radio communication antenna having a narrow beam width that may be desirably applied to a small-scale or ultra-small base station/repeater.

In accordance with an aspect of the present invention, there is provided a radio communication antenna having a narrow beam width, the radio communication antenna including: a reflective plate provided in the form of a tetragonal plate; and one radiation module installed on the reflective plate and configured to generate an X polarization, wherein the radiation module includes four radiation elements of a dipole structure, the four radiation elements are arranged at four corners of the reflective plate, respectively, two radiation arms extend along two edges with respect to one of the corners, and pairs of two radiation elements of the four radiation elements, which face each other in the diagonal direction interwork with each other and generate one polarization in the X polarization.

The distance between the radiation elements which face each other in the diagonal directions among the four radiation elements may be determined to be maximal within a range of 1λ in consideration of the processed frequency.

The reflective plate may be designed not to have an area that deviates from an installation area of the four radiation elements and substantially extends to the outside.

The radio communication antenna may further include: four directors of a conductive material that are fixedly installed in the directions in which the beams of the four radiation elements are radiated.

The radio communication antenna may further include: a radiation module that generates an X polarization at a central location of the radiation modules formed by the four radiation elements on the reflective plate.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Hereinafter, exemplary embodiments of the present invention will be described in detail with reference to the accompanying drawings. Various specific definitions found in the following description are provided only to help general understanding of the present invention, and it is apparent to those skilled in the art that the present invention can be implemented without such definitions.

Figure 1:
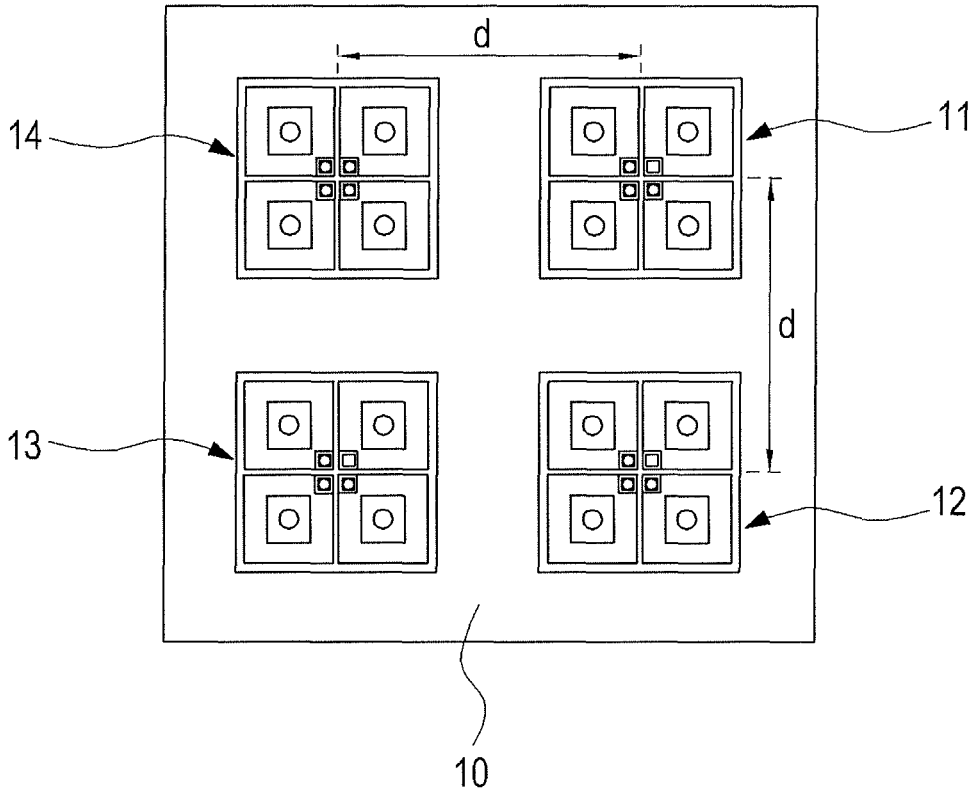
FIG. 1 is a plan view of a general radio communication antenna having a narrow beam width.
Figure 2A:
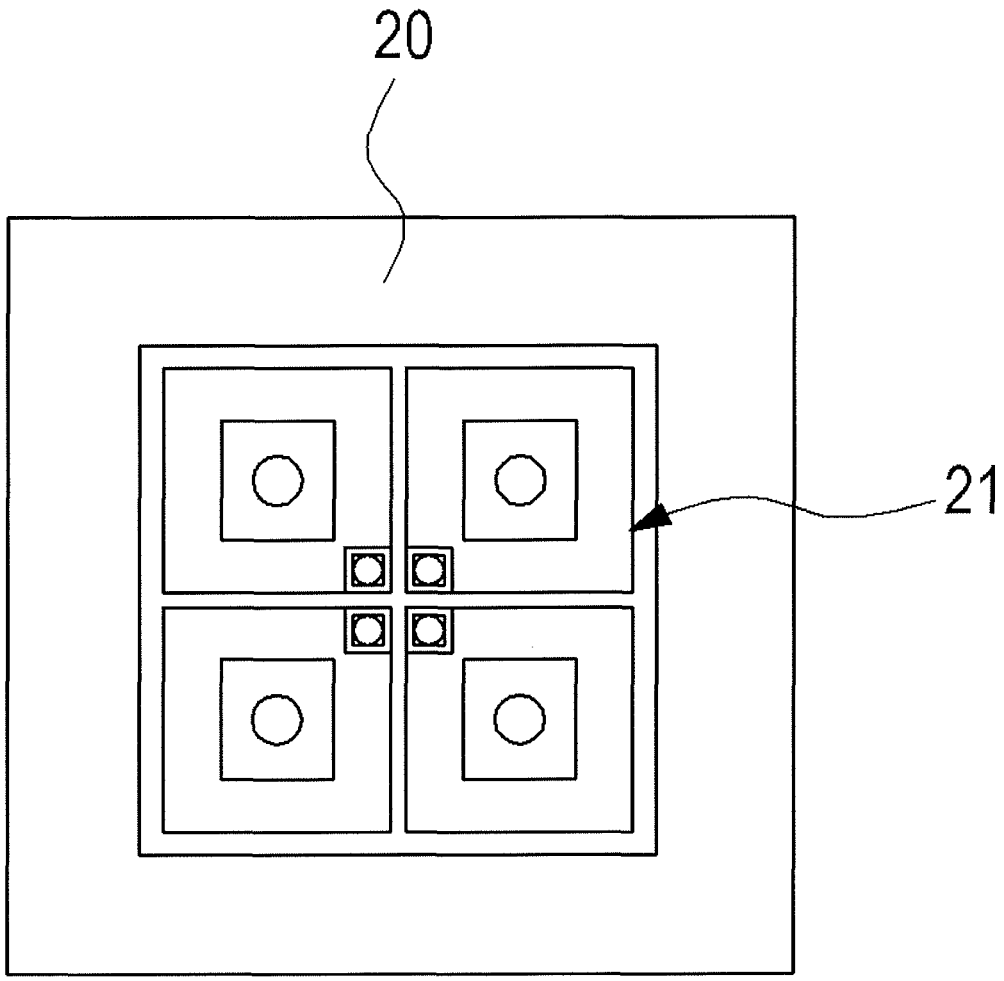
FIGS. 2A and 2B are exemplary views of the structures of radio communication antennas that may be considered to be desirably installed in a small-scale or ultra-small repeater/base station.
Figure 2B:
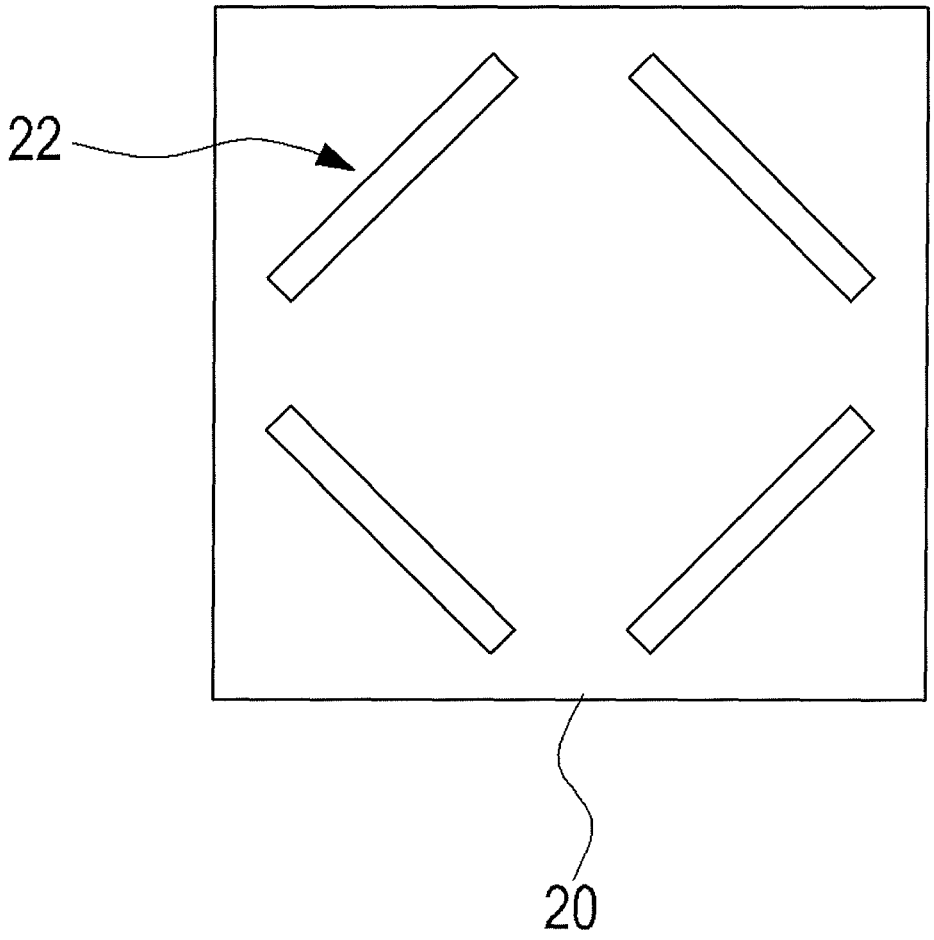

In general, when a base station in which an antenna is installed in a separate pole such as a tower, in particular, a small-scale or ultra-small base station/repeater is designed, the size thereof is a very important factor and various studies have been made for realizing a smaller design. In this case, as illustrated in FIGS. 2A and 2B, it may be considered that the small-scale or ultra-small base station/repeater has only one radiation module 21 or 22 that generates an X polarization on one reflective plate 20 (FIG. 2B illustrates an example of configuring an X polarization radiation module using elements arranged in a tetragonal or rhombus form as a whole).

However, in this way, when an antenna is designed to have one radiation module 21 or 22, there is a limit in forming a narrow beam width due to the design characteristics thereof.

Figure 3A:
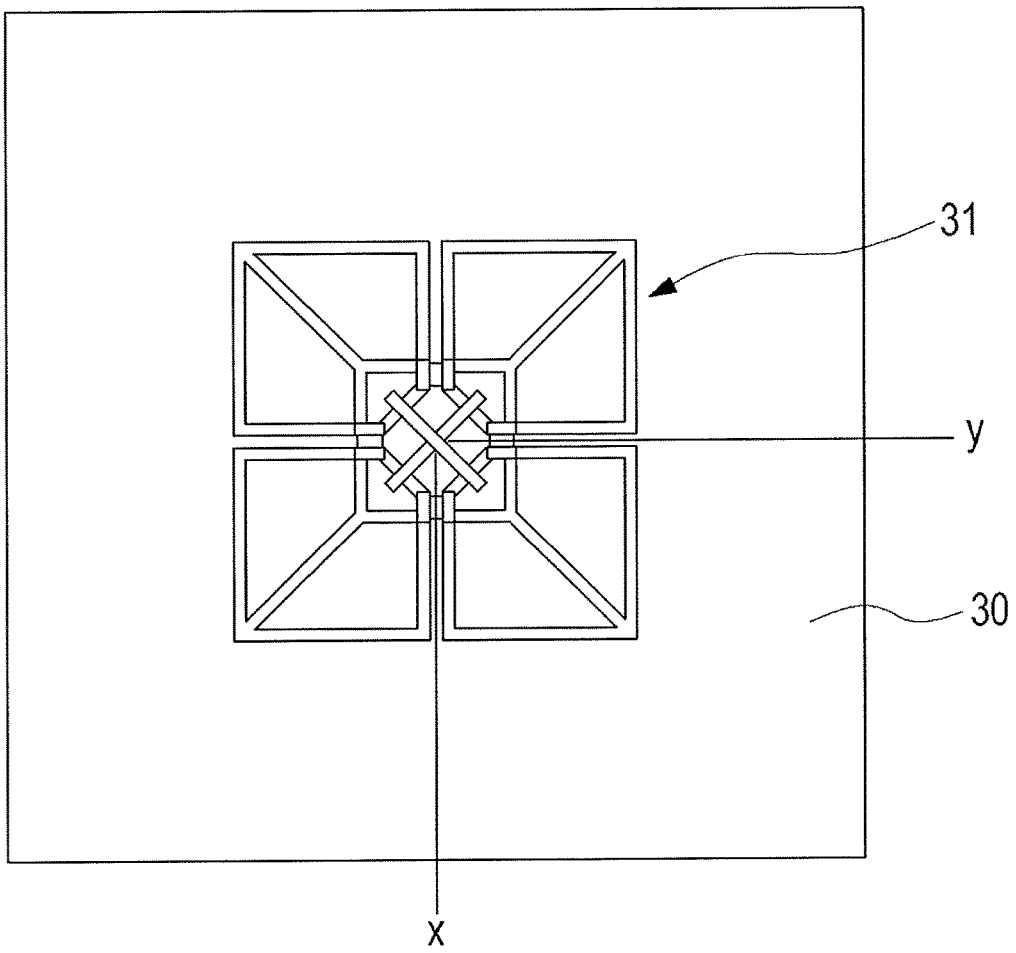
FIGS. 3A and 3B are structural views of a radio communication antenna including one radiation module that generates an X polarization, wherein the radio communication antenna may be considered as a compared structure of the present invention.
Figure 3B:
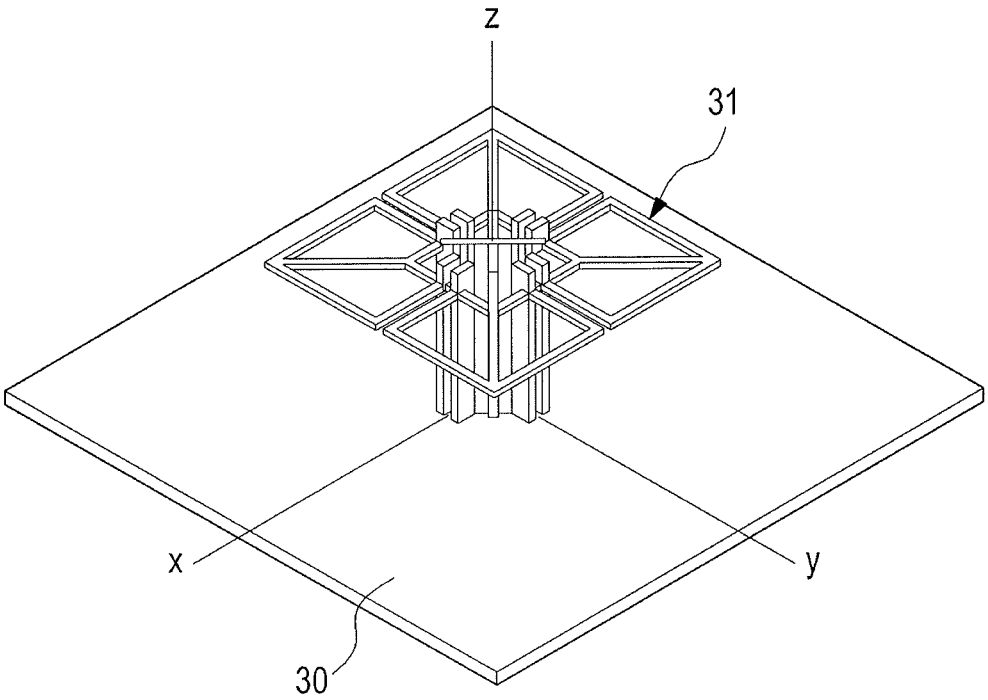
Figure 4:
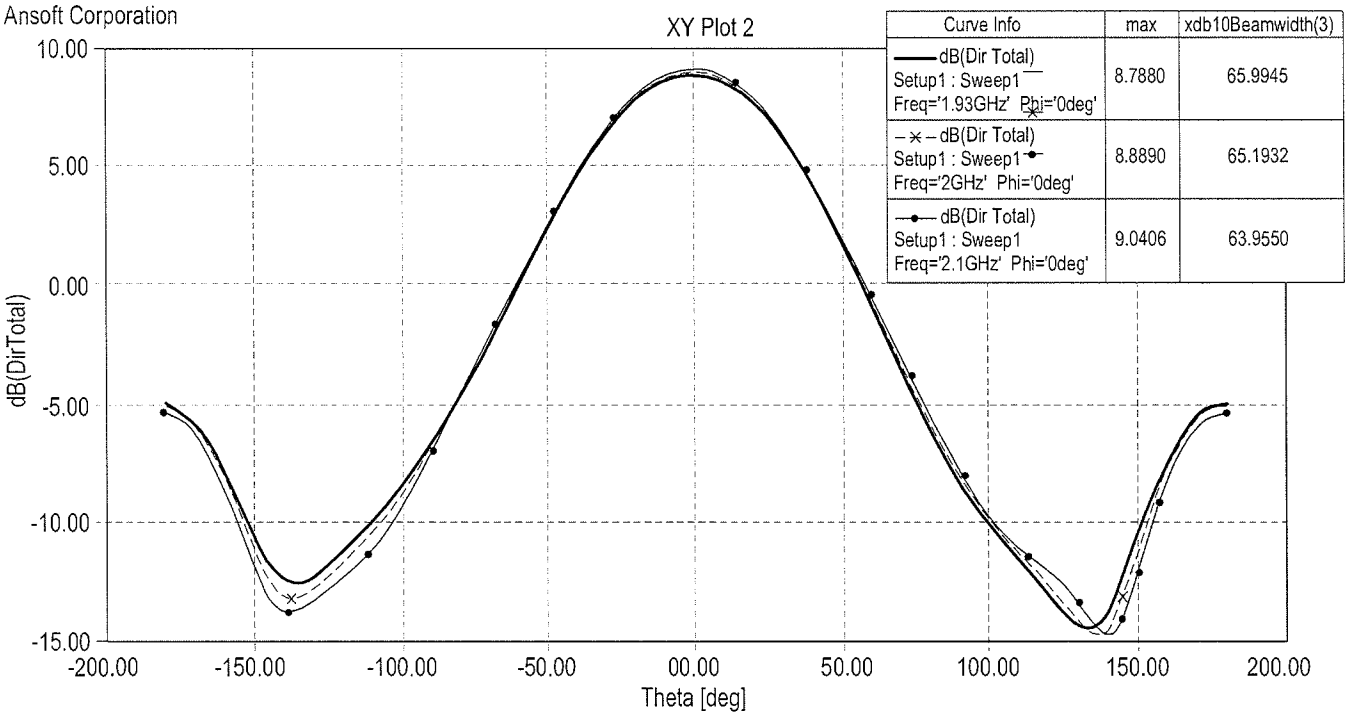
FIG. 4 is a graph depicting the radiation characteristics of the antenna of FIGS. 3A and 3B.

FIGS. 3A and 3B are a plan view and a perspective view illustrating the structure of a radio communication antenna including one radiation module that generates an X polarization. FIG. 4 is a graph depicting the radiation characteristics of the antenna of FIGS. 3A and 3B. As illustrated in FIGS. 3A to 4, when one radiation module 31 is installed in one reflective plate 30 to realize an antenna, the radiation characteristics of the antenna show that the beam width thereof is about 63 degrees, the gain thereof is about 8.8 dBi, and the side lobe thereof is about 13 dB.

As illustrated in FIGS. 3A to 4, when an antenna in which only one radiation module that generates an X polarization is installed on one reflective plate is designed in consideration of only miniaturization, the beam width characteristics of the antenna become relatively wide.

Figure 5:
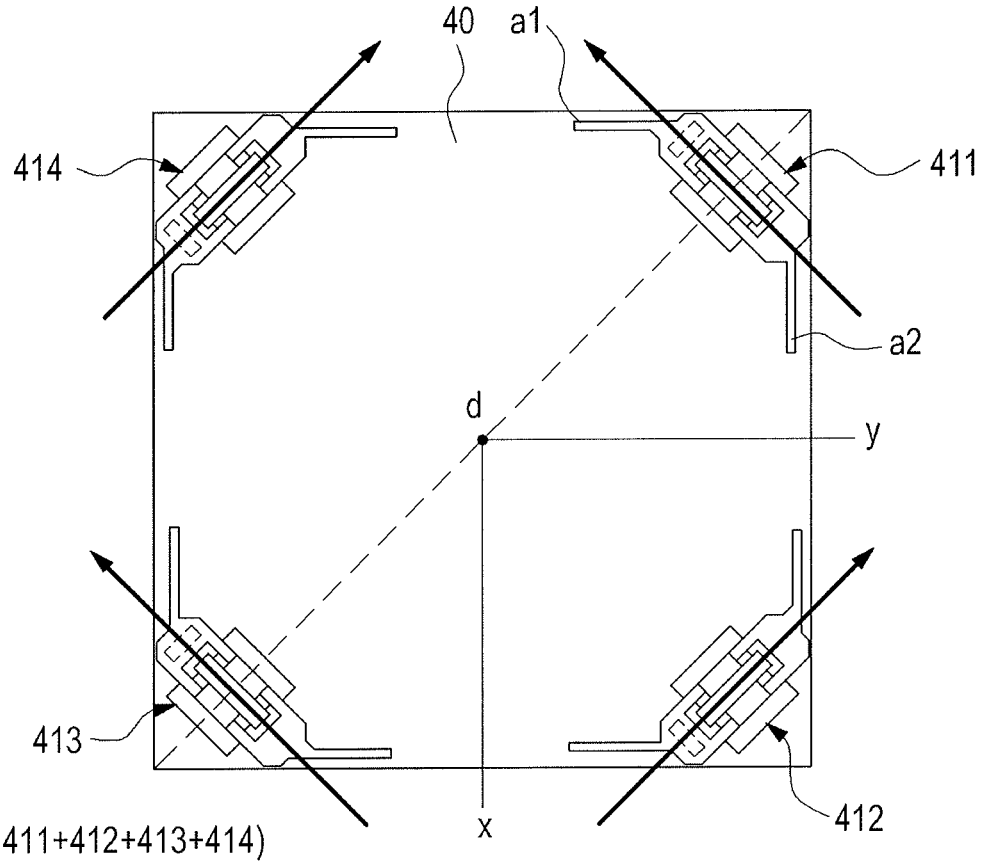
FIG. 5 is a plan view of the structure of a radio communication antenna having a narrow beam width according to a first embodiment of the present invention.
Figure 6:
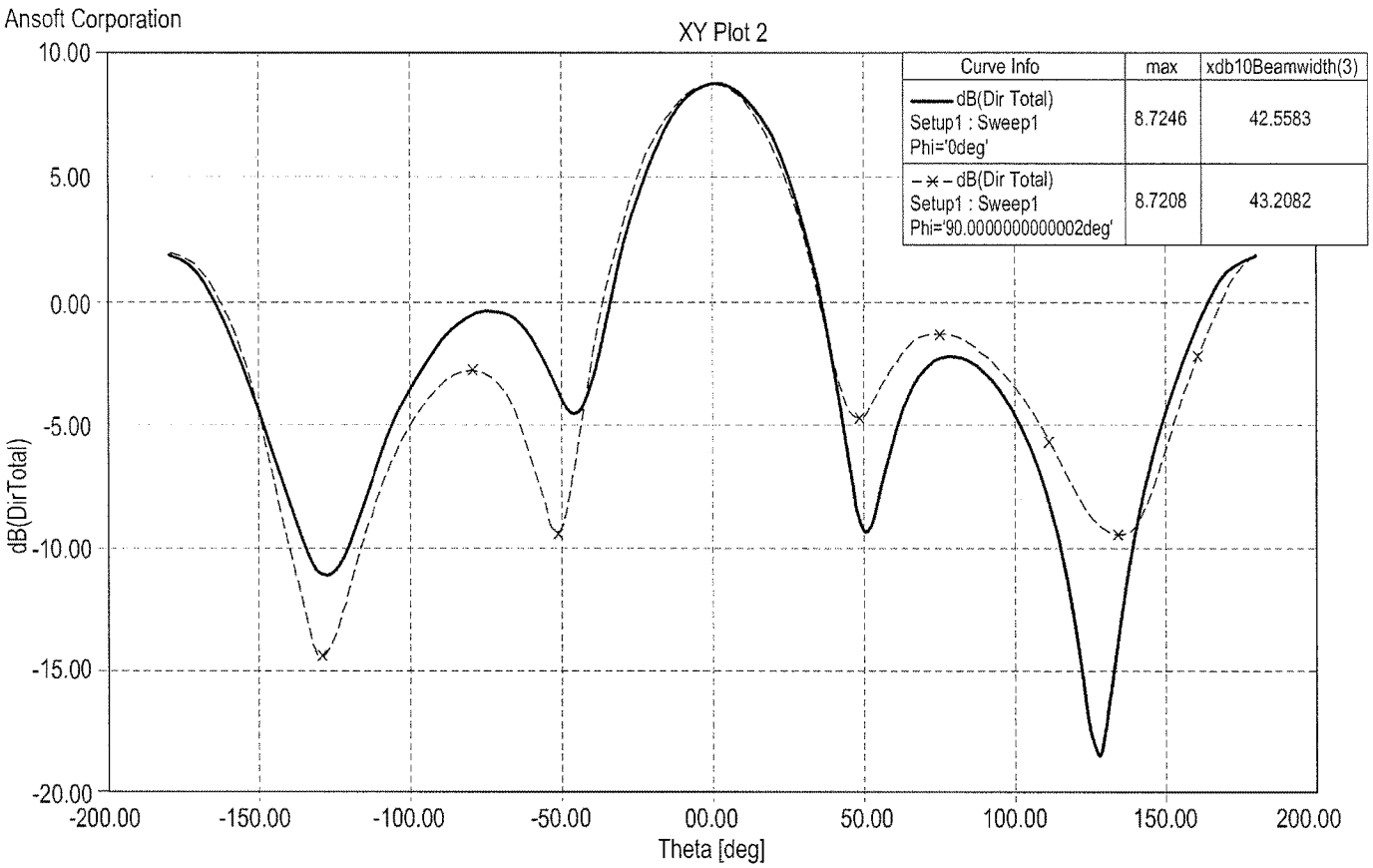
FIG. 6 is a graph depicting the radiation characteristics of the antenna of FIG. 5.
Figure 7:
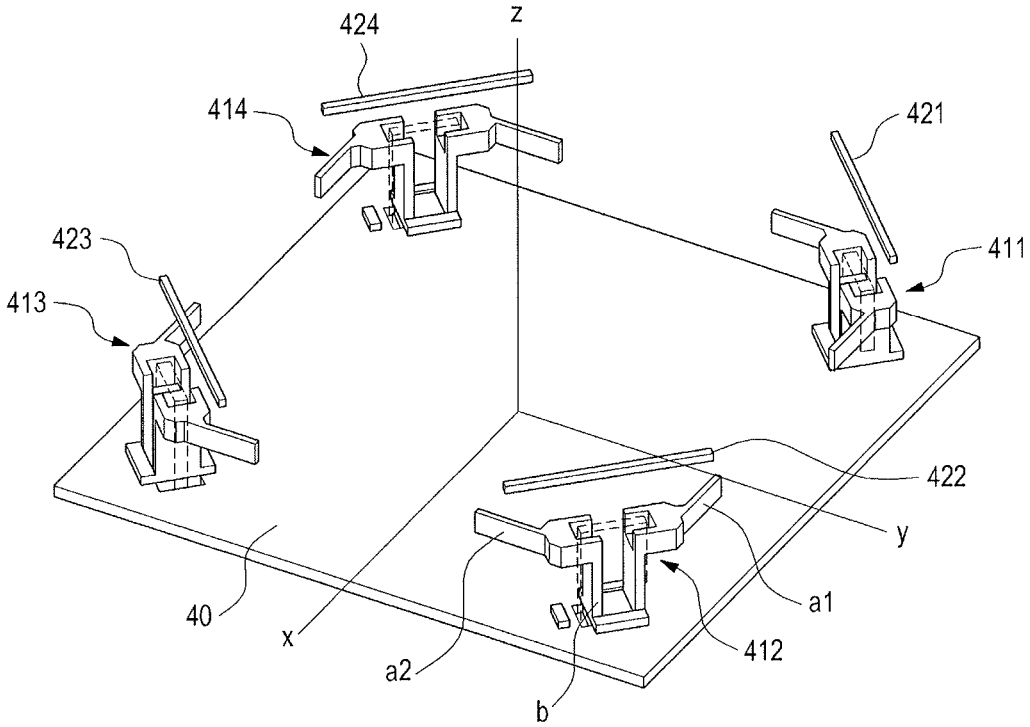
FIG. 7 is an exemplary perspective view of a modified structure of the antenna of FIG. 5.
Figure 8:
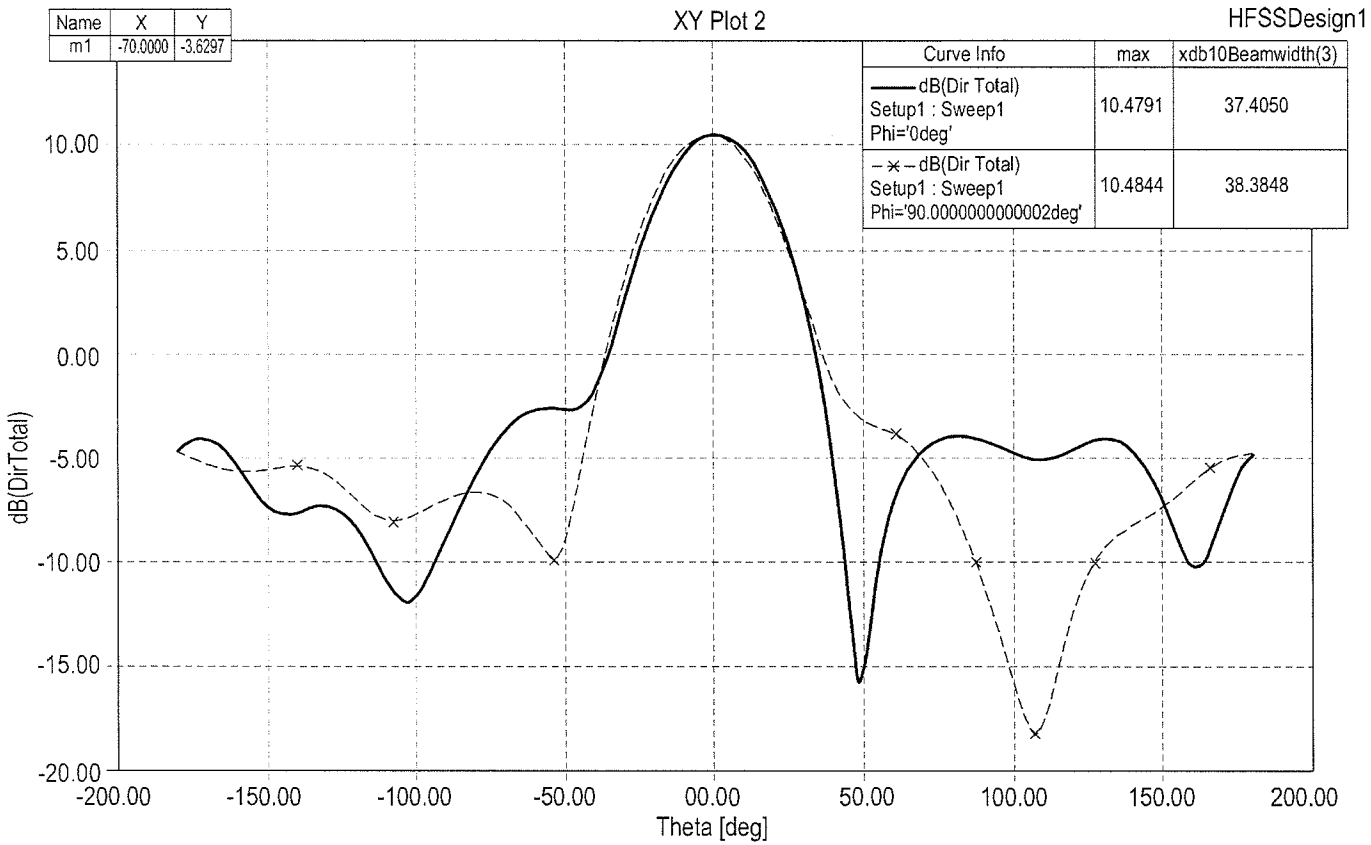
FIG. 8 is a graph depicting the radiation characteristics of the antenna of FIG. 7.

FIG. 5 is a plan view of the structure of a radio communication antenna having a narrow beam width according to a first embodiment of the present invention. The arrows of FIG. 5 indicate polarization directions generated by the radiation elements. FIG. 6 is a graph depicting the radiation characteristics of the antenna of FIG. 5. FIG. 7 is an exemplary perspective view of a modified structure of the antenna of FIG. 5. FIG. 8 is a graph depicting the radiation characteristics of the antenna of FIG. 7.

Referring to FIGS. 5 to 8, the radio communication antenna according to the first embodiment of the present invention includes one radiation module 41 that generates an X polarization on a reflective plate 40, and the radiation module 41 includes four radiation elements 411, 412, 413, and 414 having dipole structures. Then, the four radiation elements 411, 412, 413, and 414 are arranged at four corners of the reflective plate 40 having a tetragonal shape, respectively. The radiation elements 411+413 and 412+414 that face each other in the diagonal directions interwork with each other to form a feeding network (not illustrated) such that one polarization is generated in each of X polarizations.

Furthermore, the four radiation elements 411, 412, 413, and 414 include two radiation arms a1 and a2 supported by supports b of a balloon structure, respectively, similarly to a general dipole structure, and the two radiation arms a1 and a2 are positioned in a direction extending along two edges that are perpendicular to each other with respect to a corner where the corresponding element is installed. That is, according to the configuration, the planar structure of the four radiation elements 411, 412, 413, and 414 form an L shape as a whole.

Then, in order to realize a narrow beam width, the distance d between the radiation elements 411+413 and 412+414 that face each other in the diagonal directions are determined to be maximal within a range of 1λ in consideration of the processed frequency, and for example, may be determined in consideration of the side lobe characteristics of the antenna radiation pattern. In this case, the reflective plate 40 may be designed to have a minimum size without an area that deviates from an installation area of the four radiation elements 411, 412, 413, and 414 to substantially extend to the outside.

In a detailed description of the structure, the antenna according to the first embodiment of the present invention has a structure that maximally utilizes an area of the reflective plate 40 acting as the ground, and it can be seen that the distance between the radiation elements is maximized by arranging the radiation elements at the corners of the reflective plate 40 and the antenna having a narrow beam width is formed by fitting the shapes of the radiation arms of the radiation elements to the shapes of the corners of the reflective plate 40.

Referring to FIG. 6, when the antenna according to the first embodiment of the present invention illustrated in FIG. 5 is implemented, the radiation characteristics of the antenna show that the beam width thereof is a considerably narrow value of about 43 degrees, the gain thereof is about 8.7 dBi, and the side lobe thereof is about 9 dB.

Meanwhile, it can be seen that among the radiation characteristics of the antenna according to the first embodiment of the present invention including the above-described structure, the gain and side lobe characteristics are relatively unsatisfactory. This result is due to the area of the reflective plate 40 that is relatively small as compared with the sizes of the radiation elements 411, 412, 413, and 414, and as illustrated in FIG. 7, in order to solve the problem, directors 421, 422, 423, and 424 are installed in the directions in which the beams of the radiation elements 411, 412, 413, and 414 are radiated in a modified structure of the first embodiment of the present invention.

The directors 421, 422, 423, and 424 may include a metallic body of a conductive material through which a current excellently flows, and may have metal bar shapes that extend along the directions of the polarizations generated by the radiation elements 411, 412, 413, and 414. The directors 421, 422, 423, and 424 are spaced from the upper sides of the radiation elements 411, 412, 413, and 414, and it is preferable that the directors 421, 422, 423, and 424 be installed on the upper sides of the radiation elements 411, 412, 413, and 414 corresponding to a feeding portion between the two radiation arms a1 and a2.

The directors 421, 422, 423, and 424 are fixedly installed on the reflective plate 40 or on the radiation elements 411, 412, 413, and 414 through a separate support structure (not illustrated). The support structure may be formed of a synthetic resin material such as plastic or PE to minimally influence the radiation characteristics of the antenna, and may have a structure which is fixed to the directors 421, 422, 423, and 424 and the reflective plate 40 through a screw-coupling structure.

The overall sizes, shapes, and installation locations of the directors 421, 422, 423, and 424, including the support structure, are appropriately designed experimentally by measuring the characteristics of the beams radiated by the radiation elements or by simulating the corresponding characteristics.

In this way, the directors 421, 422, 423, and 424 function to guide the directions of the radiation beams generated by the radiation elements 411, 412, 413, and 414 to the forward direction to further reduce the overall beam width of the antenna and improve the characteristics of the side lobe.

Referring to FIG. 8, when the antenna that includes the director illustrated in FIG. 7 is implemented, the radiation characteristics of the antenna show that the beam width thereof is a considerably narrow value of about 37 degrees, the gain thereof is about 10.5 dBi, and the side lobe thereof is about 13 dB.

Figure 9A:
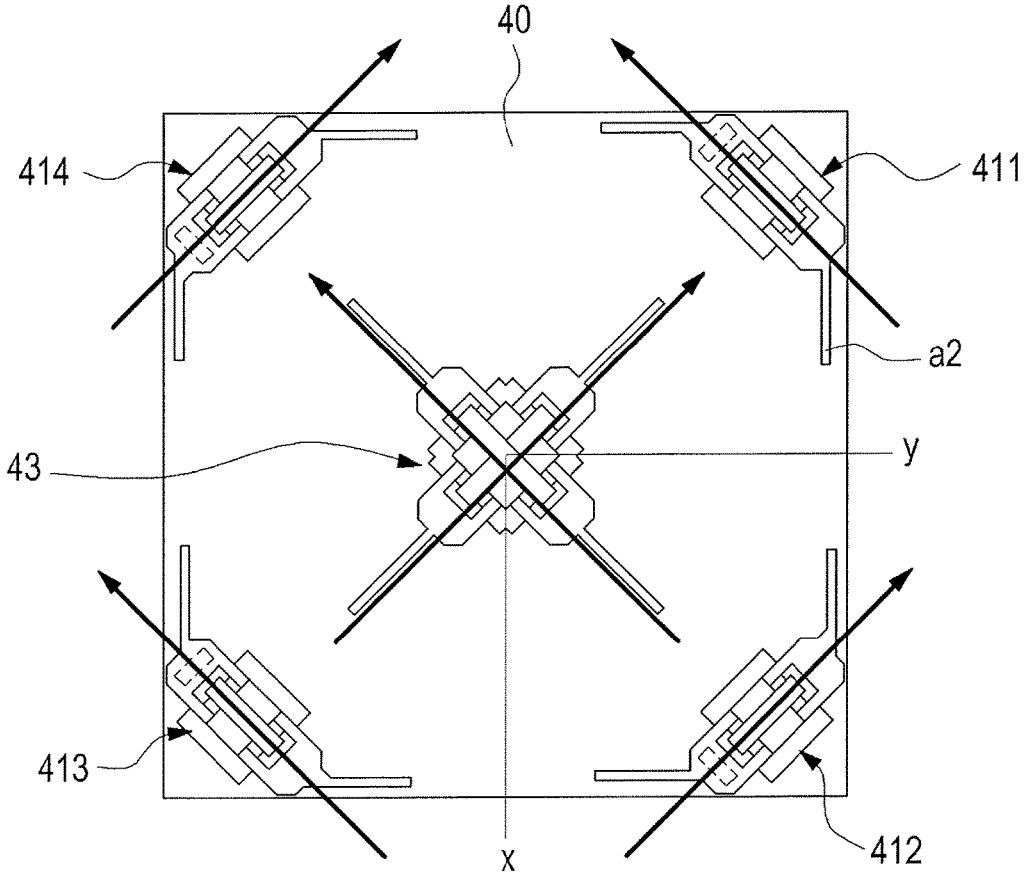
FIGS. 9A and 9B are a plan view of the structure of a radio communication antenna having a narrow beam width according to a second embodiment of the present invention.
Figure 9B:
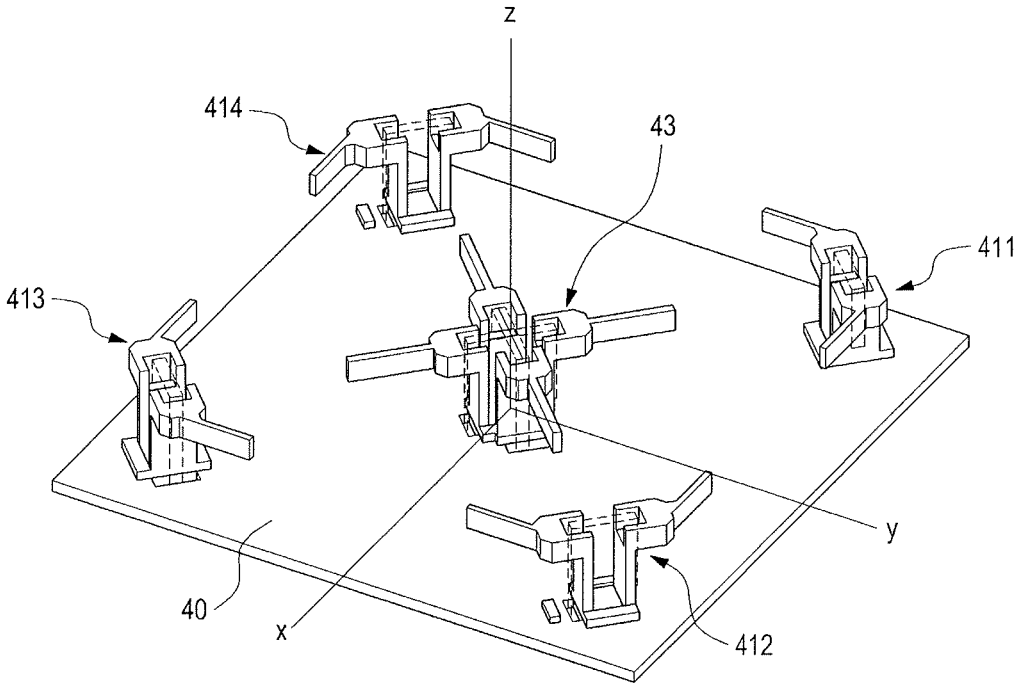
Figure 10:
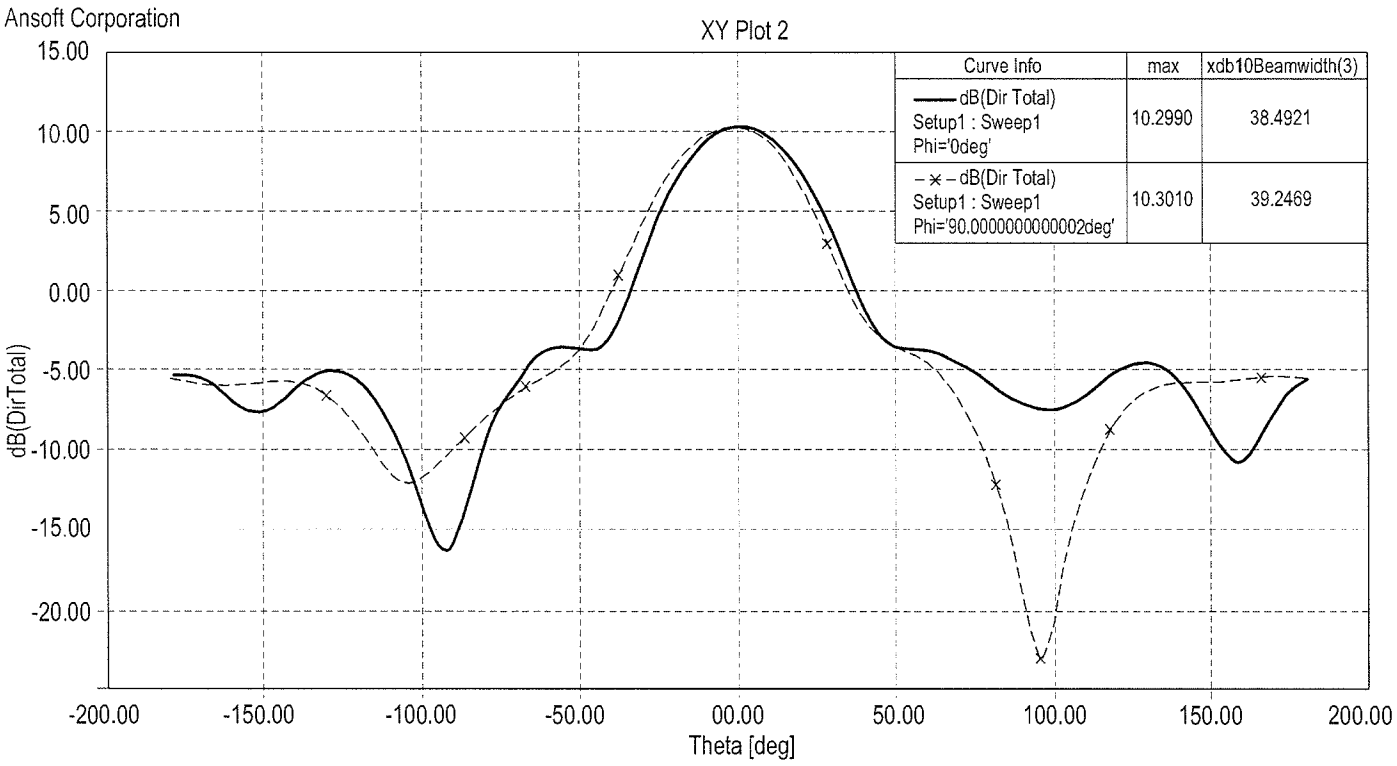
FIG. 10 is a graph depicting the radiation characteristics of the antenna of FIGS. 9A and 9B.

FIGS. 9A and 9B is a plan view of the structure of a radio communication antenna having a narrow beam width according to a second embodiment of the present invention. FIG. 10 is a graph depicting the radiation characteristics of the antenna of FIGS. 9A and 9B. The antenna according to the second embodiment of the present invention illustrated in FIGS. 9A to 10 is similar to the structure of the first embodiment illustrated in FIG. 5, but further includes a separate radiation module 43 that generates an X polarization at the center of the reflective plate 40, that is, at the center of the radiation modules formed by four radiation elements 411, 412, 413, and 414 in order to improve the side lobe characteristics and further reduce the beam width.

The radiation module 43 generates an X polarization at the center of the four radiation elements 411, 412, 413, and 414, and the radiation module 43 narrows the arrangement interval between the radiation elements including the four radiation elements 411, 412, 413, and 414 and improves the overall gain of the antenna and the characteristics of the side lobe. That is, the distance between the radiation module 43 and the four radiation elements 411, 412, 413, and 414 are set in a range of 0.5λ in consideration of the corresponding processed frequency. Referring to FIG. 10, when the antenna that includes the radiation module 43 illustrated in FIGS. 9A and 9B is implemented, the radiation characteristics of the antenna show that the beam width thereof is a considerably narrow value of about 38 degrees, the gain thereof is about 10.5 dBi, and the side lobe thereof is about 15 dB.

Figure 11:
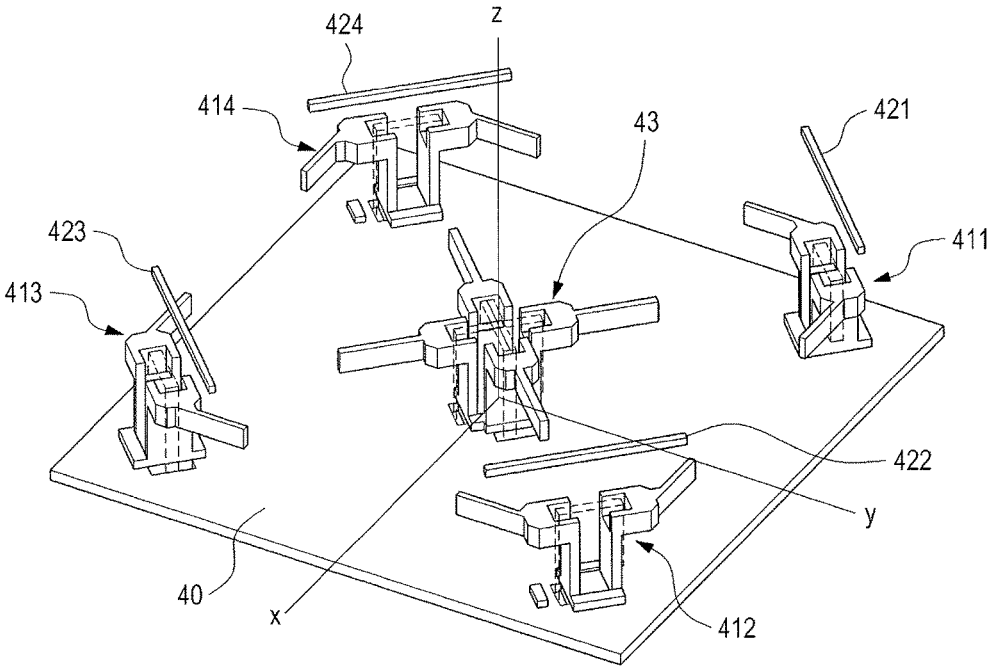
FIG. 11 is an exemplary perspective view of a modified structure of the antenna of FIGS. 9A and 9B.

FIG. 11 is an exemplary perspective view of a modified structure of the antenna of FIGS. 9A and 9B. Referring to FIG. 11, in order to further narrow the beam width radiated by the antenna, in the modified structure of the second embodiment of the present invention, the directors 421, 422, 423, and 424 are installed in the direction in which the beams of the radiation elements 411, 412, 413, and 414 are radiated, similarly to the structure illustrated in FIG. 7.

As described, the radio communication antenna having a narrow beam width according to an embodiment of the present invention may be configured and operated, and although a detailed embodiment of the present invention has been described, various modifications can be made without departing from the scope of the present invention.

For example, in the above description, in the structure of the second embodiment illustrated in FIGS. 9A and 9B, the detailed structure of the radiation module 43 installed at the central location of the reflective plate 40 may be realized by various structures such that an X polarization may be generated using radiation elements of various structures as a whole.

In this way, various modifications and variations may be made without departing from the scope of the present disclosure, and the scope of the present disclosure should not be defined by the above-described embodiments, but should be defined by the appended claims and equivalents thereto.

As described above, the radio communication antenna having a narrow beam width according to the present invention can generate a narrower beam width while having a smaller size, and have a structure that may be desirably applied to a small-scale or ultra-small base station/repeater.

What is claimed is:

1. A radio communication antenna having a narrow beam width, the radio communication antenna comprising:

a reflective plate provided in the form of a tetragonal plate; and a radiation module installed on the reflective plate and configured to generate crossed polarization, wherein the radiation module comprises four radiation elements of a dipole structure, the four radiation elements are arranged at four corners of the reflective plate, respectively, two radiation arms extend along two edges with respect to one of the corners, and pairs of two radiation elements of the four radiation elements, which face each other in the diagonal direction interwork with each other and generate one polarization in the crossed polarization, and a separate radiation module that installed at a central location of the radiation module formed by the four radiation elements on the reflective plate and generates an additional crossed polarization which combines with the crossed polarization to form a radiation beam having a predetermined beam width of the radio communication antenna, and the additional crossed polarization has the same frequency as the crossed polarization.

2. The radio communication antenna of claim 1, wherein a distance between the radiation elements which face each other in a diagonal direction is determined to be maximal within a range of 1λ in consideration of the processed frequency.

3. The radio communication antenna of claim 2, wherein the reflective plate is designed not to have an area that deviates from an installation area of the four radiation elements and substantially extends to an exterior of the radio communication antenna.

4. The radio communication antenna of claim 1, further comprising:

four directors of a conductive material that are fixedly installed in the directions in which beams of the four radiation elements are radiated.

5. The radio communication antenna of claim 4, wherein the four directors have metal bar shapes that extend along the directions of polarizations generated by the radiation elements, and are installed on the upper sides of the radiation elements corresponding to a feeding portion between two radiation arms.

* * * * *